US006979110B2

(12) United States Patent
Hasegawa et al.

(10) Patent No.: US 6,979,110 B2
(45) Date of Patent: Dec. 27, 2005

(54) AUTOMOTIVE HEADLAMP

(75) Inventors: Masaru Hasegawa, Wako (JP); Masahiko Sugama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 37 days.

(21) Appl. No.: 10/731,934

(22) Filed: Dec. 9, 2003

(65) Prior Publication Data

US 2004/0125613 A1 Jul. 1, 2004

(30) Foreign Application Priority Data

Dec. 16, 2002 (JP) ..... 2002-363936

(51) Int. Cl.[7] ..... F21V 5/00
(52) U.S. Cl. ..... 362/520; 362/455; 362/507
(58) Field of Search ..... 362/507, 509, 362/520, 538, 455, 433, 546, 547, 549, 310, 362/470, 475, 479, 516, 517

(56) References Cited

U.S. PATENT DOCUMENTS 5,113,320 A * 5/1992 Haydu ..... 362/549
5,251,111 A * 10/1993 Nagengast et al. ..... 362/547
5,327,330 A * 7/1994 Van Oel et al. ..... 362/547
5,497,299 A * 3/1996 Wisler et al. ..... 362/548
5,975,729 A * 11/1999 Dobler et al. ..... 362/507
6,161,951 A * 12/2000 Yoneyama et al. ..... 362/516
6,161,953 A * 12/2000 Chouji et al. ..... 362/546
6,454,449 B2 * 9/2002 Nestell et al. ..... 362/520
6,520,659 B2 * 2/2003 Nishiyama et al. ..... 362/96
6,543,920 B2 * 4/2003 Fujinami et al. ..... 362/517
6,595,672 B2 * 7/2003 Yamaguchi ..... 362/547

FOREIGN PATENT DOCUMENTS

JP 6-50113 7/1994

* cited by examiner

*Primary Examiner*—Stephen Husar
*Assistant Examiner*—Hargobind S. Sawhney
(74) *Attorney, Agent, or Firm*—Hamre, Schumann, Mueller & Larson, P.C.

(57) ABSTRACT

In an automotive headlamp 10, a lens flange portion 24 is caused to extend from a circumferential edge 23 of a lens surface 18 formed into a configuration which follows the outline of an external surface 19 of a vehicle body toward a lamp housing 11, a surface-roughening process is applied to a surface 25 of an end portion of the lens flange portion 24 to make irregular the surface 25 of the end portion, and a leg portion 28 is caused to extend from a location 27 which deviates from the surface 25 of the end portion in such a manner as to bypass the surface 25 of the end portion, so that the leg portion 28 fits in the lamp housing 11.

5 Claims, 6 Drawing Sheets

AUTOMOTIVE HEADLAMP

BACKGROUND OF THE INVENTION

The present invention relates to an automotive headlamp that is built in a vehicle body for use.

There is an automotive headlamp as one of automotive illumination lamps (for example, refer to Patent Literature No. 1).

[Patent Literature No. 1]

JP-UM-A-6-50113 (Page 5, FIG. 1)

Patent Literature No. 1, which is referred to above, will be described in detail by reference to the following drawing.

FIG. 6 is a cross-sectional view illustrating a state in which a related automotive headlamp is mounted on a vehicle body. Note that new reference numerals are now imparted.

According to this related automotive headlamp 100, light is emitted from a light source bulb 101, the light so emitted is reflected in parallel with an optical axis 103 by a reflector 102, and the reflected light is then passed through a lens 105 so as to illuminate ahead of a vehicle body 106.

The automotive headlamp 100 is accommodated in an accommodation space 107 in the vehicle body 106 with a lens surface 105*a* being caused to follow the outline of a vehicle body surface 106*a*.

This lens 105 has a lens flange portion 111 which is extended from a circumferential edge 109 toward a lamp housing 101 side, and irregularities (not shown) are formed on an inner surface of the lens flange portion 111 by embossing, a paint membrane 111*a* being formed on the surface having the irregularities.

This construction can prevent the leakage of light from the periphery of the lens surface 105*a* and help conceal interior structures such as the reflector 102 when the headlamp 100 is turned off.

Here, since the automotive headlamp 100 is accommodated in the accommodation space 107 in the vehicle body 106, a gap S needs to be provided between the automotive headlamp 100 and the vehicle body 106.

When considering the external appearance of the automobile, this gap S is preferably maintained as small as possible.

In order to maintain the gap S as small as possible, however, production tolerances for respective members constituting the accommodation space 107 in the vehicle body 106 and the lens 105 need to be maintained as small as possible, and assembling tolerances for these members also need to maintained as small as possible.

Due to this, it takes time to complete the processes of producing and assembling those members together, which is constituting a cause of preventing the reduction of production costs.

As an example of countermeasures against this, there is known a technique in which a plated molding (not shown) is added to the circumferential edge 109 of the lens 105 so as to reduce the gap S between the automotive headlamp 100 and the vehicle body 106.

In this technique, however, the plated molding is additionally required, and a certain number of man-hours is also required. Eventually, these also constitute causes of preventing the reduction of production costs.

SUMMARY OF THE INVENTION

Thus, an object of the invention is to provide an automotive headlamp which can make the gap between the automotive headlamp and the vehicle body less conspicuous.

While proceeding with experiments on eliminating totally a gap between the automotive headlamp and the vehicle body or maintaining the same as small as possible, the inventor and et al. found that the existing gap appeared larger than what it is in reality as the leg portion on the lens flange looked black when it is fitted in a recessed fitting space in the lamp housing and is viewed from the front of the vehicle.

From this, the inventor and et al. came to have a prospect that the gap appearing to exist when viewed from the front of the vehicle could be made to look totally eliminated or reduced to some extent by devising the fitting structure between the lens flange and the housing.

To be specific, according to a first aspect of the invention, there is provided an automotive headlamp in which a lens surface is positioned in an opening in an accommodation space when the headlamp is accommodated in the accommodation space, characterized in that a lens flange portion is provided to extend from a circumferential edge of the lens surface toward a lamp housing, in that a surface-roughening process or painting is applied to a surface of an end portion of the lens flange portion, and in that a leg portion is provided to extend from a location which deviates from the surface of the end portion so as to bypass the surface of the end portion, so that the leg portion fits in the lamp housing.

The lens flange portion is caused to extend from the circumferential edge of the lens surface toward the lamp housing, and the surface-roughening process or painting is applied to the surface of the end portion of the lens flange portion, whereby, when external light enters the lens flange portion from the circumferential edge of the lens surface, the external light is reflected by the surface of the end portion to there by diffused or is reflected by the painted location.

Due to this, the lens portion is made to look white so that the circumferential edge of the lens surface is allowed to look larger, whereby the gap between the automotive headlamp and the vehicle body can be made to look as if it are totally eliminated or reduced.

Here, since an adhesive is used when the leg portion is fitted in the lamp housing, the adhesive exits in the fitting portion where the leg portion is fitted in the lamp housing, the reflection of light being thereby prevented. In addition, in order to make invisible inner structures within the lamp housing, the lamp housing is usually painted black. Due to this, the fitting portion between the leg portion and the lamp housing looks black.

To cope with this, the leg portion is caused to extend from the location which deviates from the surface of the end portion to which the surface-roughening process or painting is applied in such a manner as to bypass the end portion, so that the leg portion eventually fits in the lamp housing.

Thus, the fitting portion where the leg portion fits in the lamp housing is spaced away from the surface of the end portion to which the surface-roughening process or painting is applied so as to form a space therebetween, whereby the shadow of the fitting portion which reflects on the surface of the end portion can be prevented from being reflected on the circumferential edge of the lens surface.

DETAILED DESCRIPTION OF THE PREFERRED EMBODIMENTS

Embodiments of the invention will be described below based on the accompanying drawings. When used herein, "front", "rear", "left" and "right" follow such directions as viewed from the driver.

Figure 1:
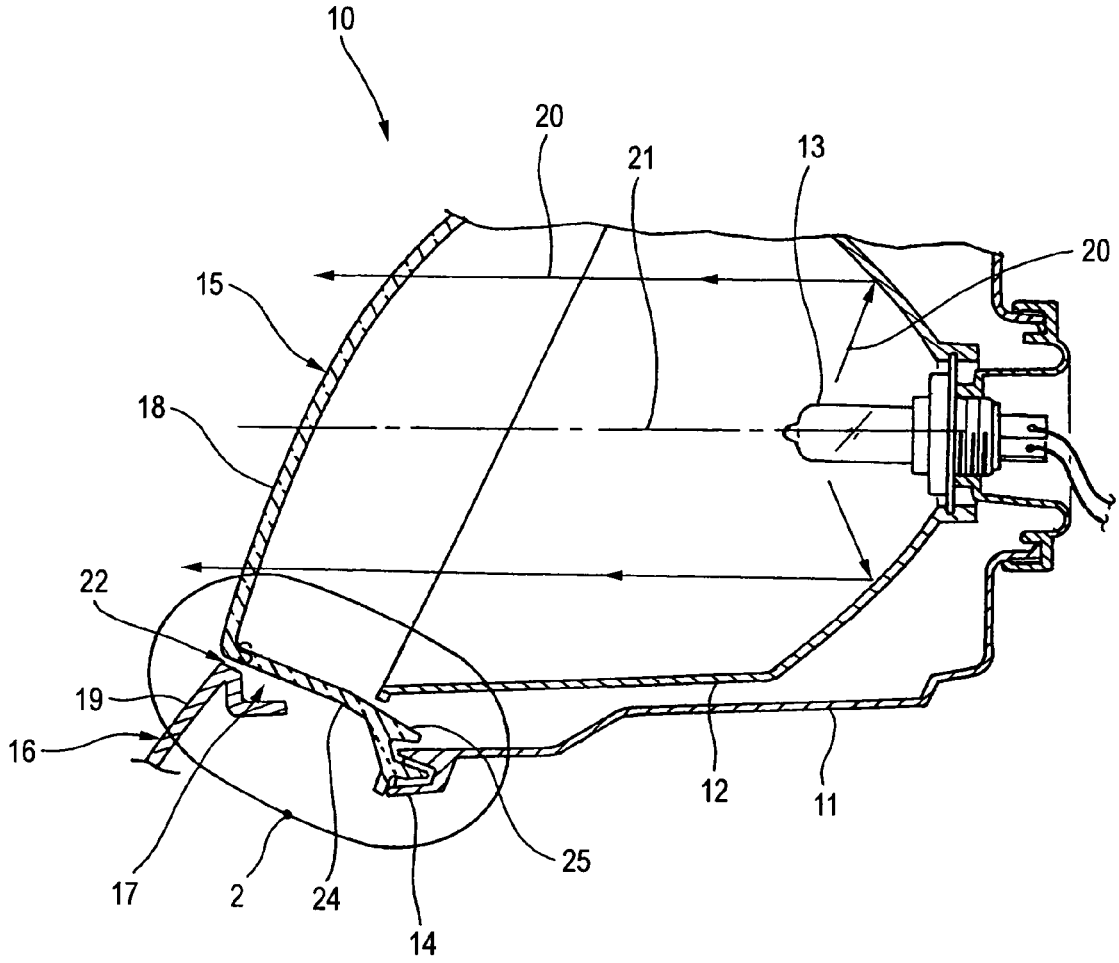
FIG. 1 is a cross-sectional view illustrating an automotive headlamp (a first embodiment) according to the invention.

FIG. 1 is a cross-sectional view illustrating an automotive headlamp (a first embodiment) according to the invention.

In an automotive headlamp 10, a reflector 12 is accommodated within a lamp housing 11, and a light source bulb 13 is disposed at a focal point of the reflector 12, a front end opening 14 of the lamp housing 11 being covered with a lens 15. Then, when accommodated in an accommodation space 17 in a vehicle body 16, the automotive headlamp 10 so constructed is positioned such that a lens surface 18 of the lens 15 is disposed in an opening 22 in the accommodation space 17 with the surface 18 of the lens 15 being formed into a configuration which follows the outline of an external surface 19 of the vehicle body.

Thus, when light 20 is emitted from the light source bulb 13, the light 20 so emitted is reflected in parallel with an optical axis 21 by the reflector 12, so that the light 20 so reflected can be passed through the lens 15 to be emitted ahead of the vehicle body 16.

Figure 2:
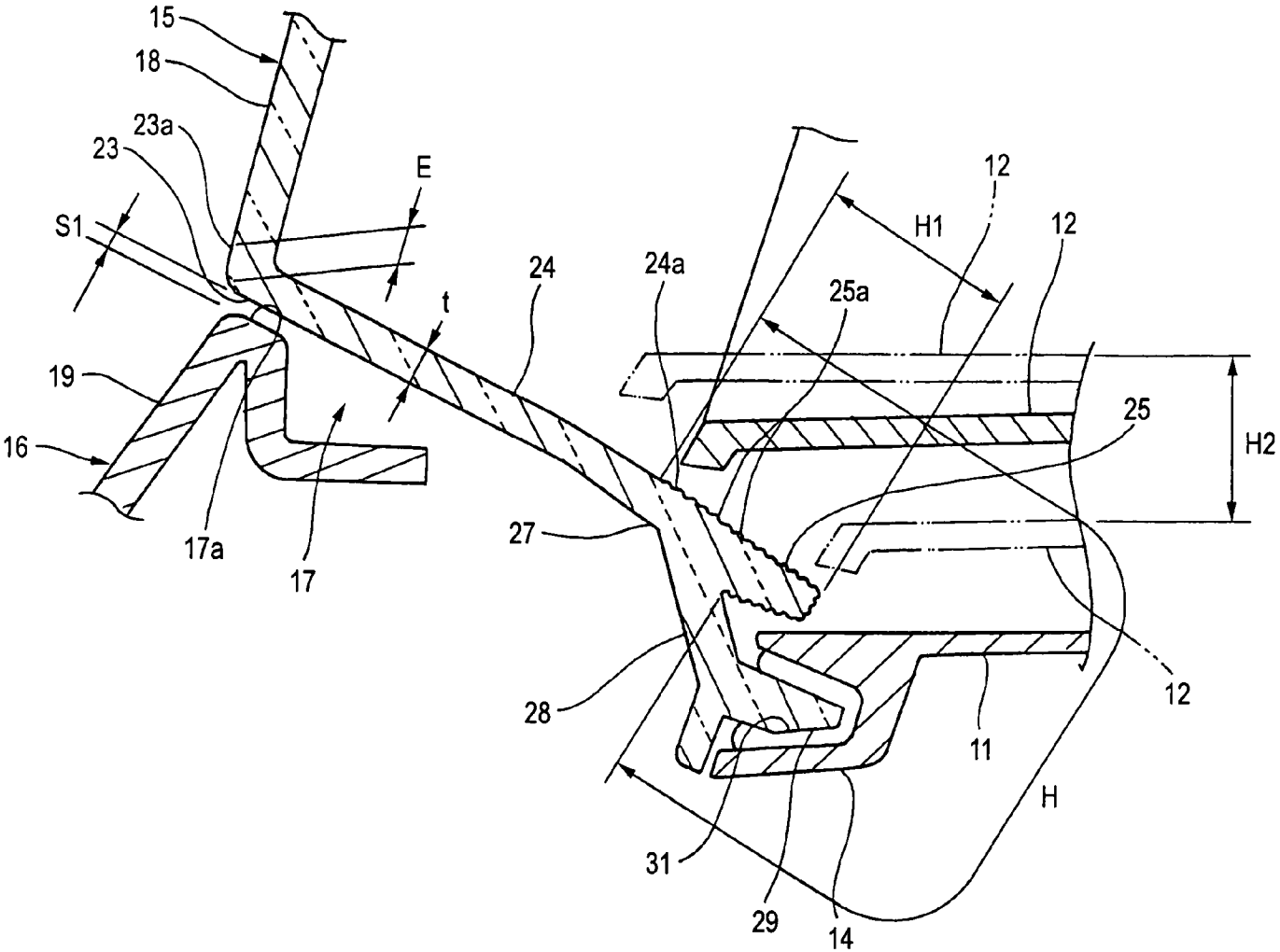
FIG. 2 is an enlarged view of a part denoted by reference numeral 2 in FIG. 1.

FIG. 2 is an enlarged view of a portion denoted by reference numeral 2 in FIG. 1.

In the lens 15, a lens flange portion 24 is caused to extend from a circumferential edge 23 of the lens surface 18 toward the lamp housing 11, and a surface-roughening process such as providing embosses 25*a* . . . is applied to a surface 25 of an end portion (illustrated by a range H) of the lens flange portion 24. Then, a leg portion 28 is caused to extend from a location 27 which deviates from the surface 25 of the end portion to which the surface-roughening process is applied in substantially a V-shaped fashion so as to bypass the surface 25 of the end portion, so that a distal end 29 of the leg portion 28 fits in a recessed fitting space 31 in the lamp housing 11.

The recessed fitting space 31 is formed in the front end opening 14 in the lamp housing 11.

In this state, the circumferential edge 23 of the lens surface 18 is in a state in which the circumferential edge 23 is spaced away from an accommodation edge 17*a* of the accommodation space 17 with a certain gap S1 being provided therebetween.

The lens flange portion 24 is formed such that the portion extends substantially linearly from the circumferential edge 23 of the lens surface 18 toward the lamp housing 11 and has a thickness t with the surface-roughening process such as providing embosses 25*a* . . . being applied to the surface 25 of the end portion thereof.

Thus, by allowing the lens flange portion 24 to extend from the circumferential edge 23 of the lens surface 18 toward the lamp housing 11 and applying the surface-roughening process to the surface 25 of the end portion of the lens flange portion 24, external light which enters the lens flange portion 24 from an inner location 23*a* which extends along the circumferential edge 23 of the lens surface 18 can be reflected and diffused by the surface 25 of the end portion.

This allows the inner location 23*a* which extends along the circumferential edge 23 to look white.

Here, of the range H, a range H1 on an inner surface of the lens flange portion 24 is set such that the range is positioned on the outside of the reflector 12, whereby in emitting light 20 radiated from the light source bulb 13 ahead of the lens 15, a traveling course of the light 20 is designed not to be interrupted by the surface 25 of the end portion.

Note that the automotive headlamp 10 is designed such that the position of the reflector 12 can be moved within a range H2 indicated by imaginary lines so as to deal with different types of reflectors 12 or to allow the adjustment of the optical axis 21.

Due to this, the range H1 on the inner surface of the lens flange portion 24 is set so as to satisfy a case where the reflector 12 moves within the range H2.

The leg portion 28 is formed substantially into a V shape on the lens flange portion 24 in such a manner as to extend outwardly from the location 27 which deviates from the surface 25 of the end portion, so that the distal end 29 of the leg portion 28 fits in the recessed fitting space 31 in the lamp housing 11.

This allows the front end opening 14 in the lamp housing 11 to be covered with the lens 15.

Figure 3:
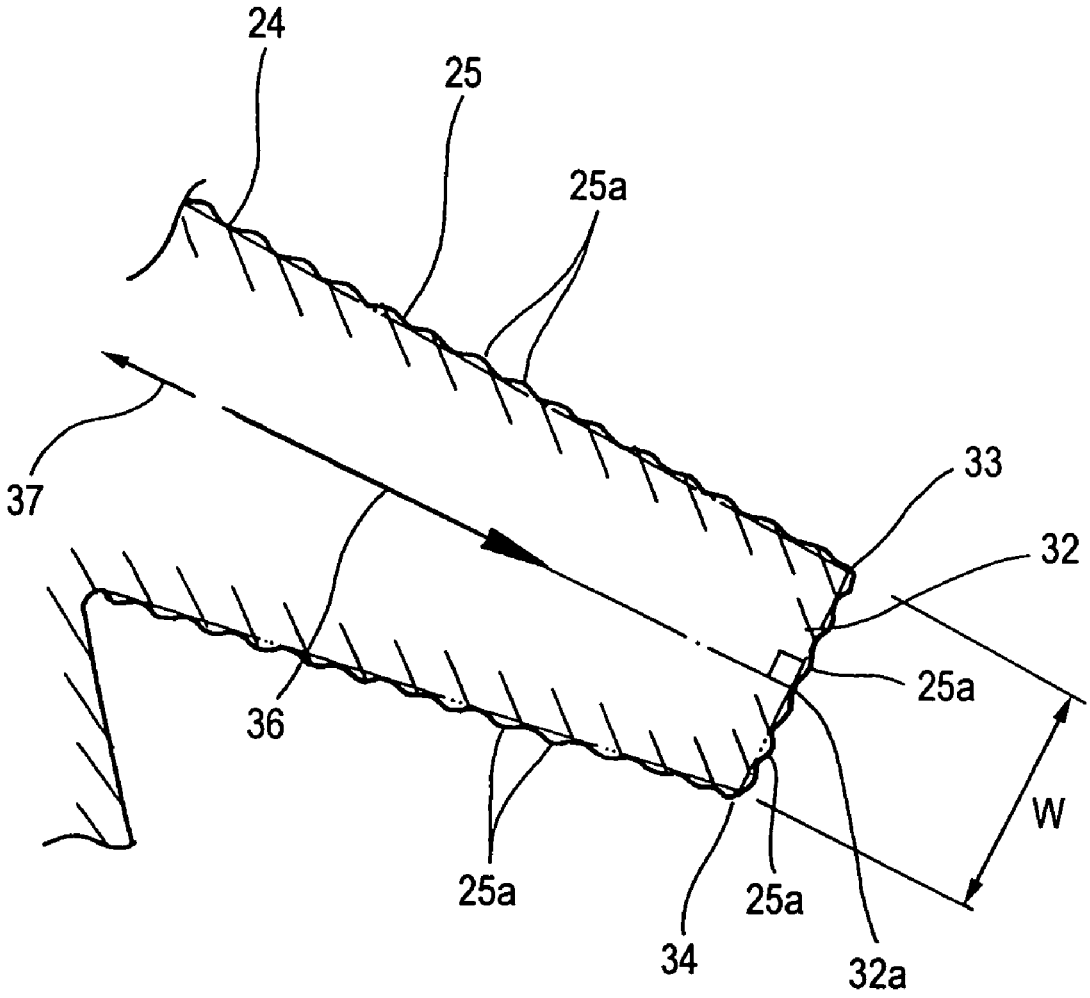
FIG. 3 is an enlarged view illustrating a main part of a lens flange portion which constitutes the automotive headlamp (the first embodiment) according to the invention.

FIG. 3 is an enlarged view illustrating a main part of the lens flange portion which constitutes the automotive headlamp (the first embodiment) according to the invention. Note that an imaginary line is imparted for the sake of easing the understanding of the invention. The lens flange portion 24 is formed such that inner and outer corners 33, 34 of an end 32 of the surface 25 of the end portion thereof become substantially square.

From this construction, a width W of an end face 32*a* of the end 32 can be enlarged.

By causing this end face 32*a* to be reflected in the inner location 23*a* (refer to FIG. 2) which extends along the circumferential edge 23 of the lens surface 18, a white area E having a relatively large width which corresponds to the width W of the end face 32 can be secured in the inner location 23*a* of the circumferential edge 23.

In addition, the end face 32*a* of the lens flange portion 24 is a surface that is formed so that external light 36 such as the sun's rays is allowed to is incident thereto at right angles.

Thus, light 37 reflected at the end face 32*a* of the lens flange portion 24 can be returned to the inner location (refer to FIG. 2) of the circumferential edge 23 of the lens surface 18 with good efficiency.

From this construction, the white area E (refer to FIG. 2) having the relatively wide width can be clearly reflected on the inner location 23*a* of the circumferential edge 23.

Furthermore, embosses 25*a* . . . are formed on the end face 32*a* of the lens flange portion 24, and a knurling process is also applied thereto.

By knurling the end face 32*a*, the end face 32*a* is knurled so as to have sawtooth serrations (not shown) formed thereon. Since these knurled sawtooth serrations are shaped smaller than the embosses 25*a* . . . , the external light 36 can be diffused with a better efficiency so that the white area E having the relatively wide width can be clearly reflected on the inner location 23*a* (refer to FIG. 2) of the circumferential edge 23 of the lens surface 18.

In addition, it is highly possible that the process of forming the embosses 25*a* . . . and the knurling process are performed at the same time as a lens 15 is formed. Due to formed embosses 25*a* . . . protruding from the surface of an end face of a lens flange portion 24, there will be a risk that the embosses 25*a* . . . are brought into contact with a mold when the lens is removed from the mold to thereby be damaged.

On the other hand, due to knurled sawtooth serrations so formed being in a recessed condition, there will be no risk that the knurled serrations are brought into contact with the mold when the lens is removed from the mold.

Due to this, by knurling the end face 32*a*, the white area E (refer to FIG. 2) having the relatively wide width is allowed to be reflected in the inner location 23*a* (refer to FIG. 2) of the circumferential edge 23 of the lens surface 18 in an ensured manner.

Next, the function of the automotive headlamp will be described based upon FIGS. 4 and 5.

Figure 4A:
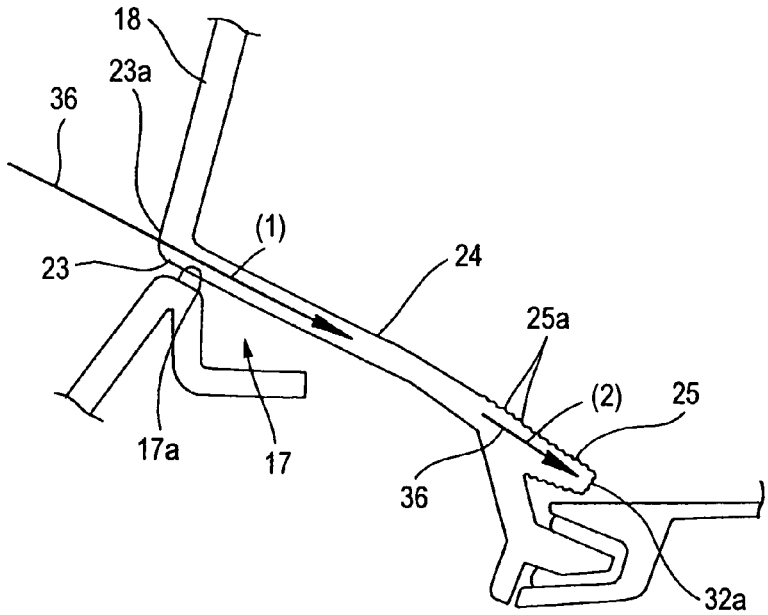
FIGS. 4A and 4B are explanatory views illustrating the function of the automotive headlamp (the first embodiment) according to the invention.
Figure 4B:
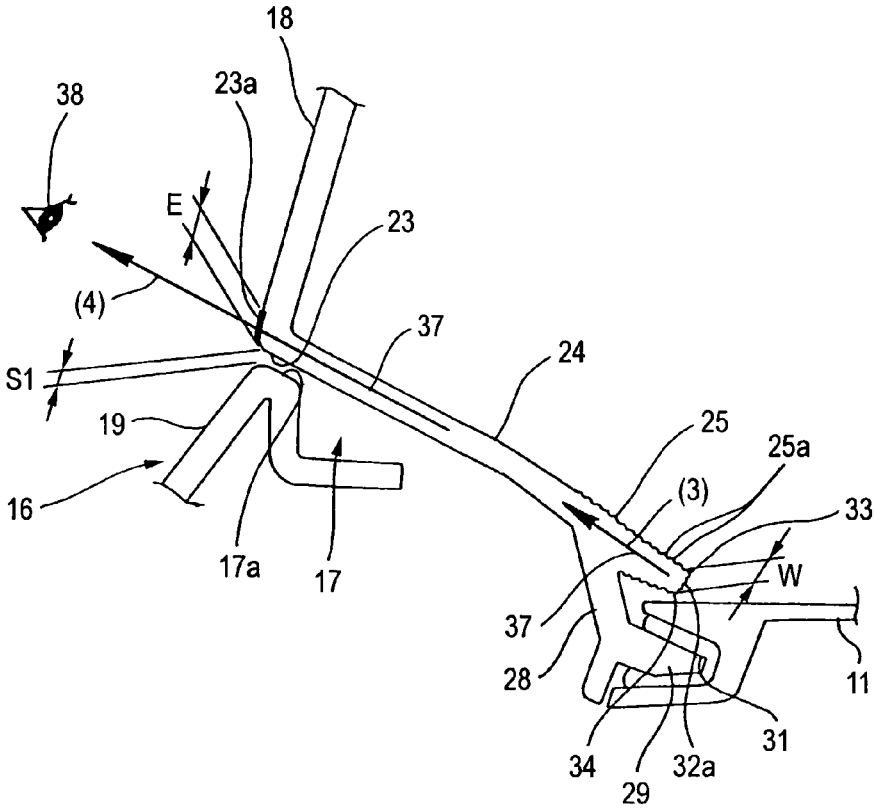

FIGS. 4A and 4B are explanatory diagrams illustrating the function of the automotive headlamp (the first embodiment) according to the invention.

In FIG. 4A, external light 36 such as the sun's rays enters the lens flange portion 24 from the inner location 23*a* which extends along the circumferential edge 23 of the lens surface 18 as indicated by an arrow ①. Then, the external light 36 that has so entered then enters the end face 32*a* substantially at right angles as indicated by an arrow ②.

As this occurs, the external light that has entered the lens flange portion 24 can be diffused at the surface 25 of the end portion 25.

In FIG. 4B, the external light 36 (refer to FIG. 4A) that has so entered is reflected at the end face 32*a* as indicated by an arrow ③. The reflected light 37 reaches the eye 38 of a person who stands in front of the vehicle as indicated by an arrow ④.

From this construction, the inner location 23*a* which extends along the circumferential edge 23 of the lens flange portion 24 is allowed to be seen as the white area E which is clearly reflected therein.

As is described heretofore, the inner location 23*a* which extends along the circumferential edge 23 of the lens flange portion 24 is allowed to look white so that the circumferential edge 23 of the lens surface 18 can be seen larger.

Consequently, the gap S1 between the automotive headlamp 10 and the vehicle body 16 is seen as if the gap S1 are totally eliminated or reduced, whereby the gap S1 can be made invisible.

Here, usually, an adhesive is used in order for the distal end 29 of the leg portion 28 to be fixedly fitted in the recessed fitting space 31 in the lamp housing 11. Thus, since the adhesive remains adhering to the fitting portion where the distal end 29 of the leg portion 28 fits in the recessed fitting space 31, the light is made to be difficult to reflect. In addition to this, the lamp housing 11 is usually painted black in order to make inner structures of the automotive headlamp 10 invisible.

Due to these constructions, the fitting portion between the distal end 29 of the leg portion 28 and the recessed fitting space 31 in the lamp housing 11 looks dark.

Then, the leg portion 28 is made to extend from the location 27 which deviates from the surface 25 of the end portion in such a manner as to bypass the surface 25 of the end portion, so that the leg portion 28 fits in the lamp housing 11. Consequently, since the fitting portion where the distal end 29 of the leg portion 28 fits in the recessed fitting space 31 of the lamp housing 11 can be spaced away from the surface 25 of the end portion, a space 40 can be formed between the fitting portion and the surface 25 of the end portion.

From this construction, it becomes possible to avoid the reflection of a shadow of the fitting portion where the distal end 29 of the leg portion 28 fits in the recessed fitting space 31 of the lamp housing 11 on the surface 25 of the end portion, so that the reflection of the shadow of the fitting portion on the inner location 23*a* extending along the circumferential edge 23 of the lens surface 18 can in turn be prevented.

Consequently, it is possible to make the circumferential edge 23 of the lens surface 18 look sharply, whereby the gap S1 between the automotive headlamp 10 and the vehicle body 16 can be made invisible further.

In addition, the leg portion 28 is locked such that the inner and outer corners 33, 34 of the end 32 which constitutes the surface 25 of the end portion are made substantially square.

This helps increase the width W of the end face 32*a* of the end 32, whereby the end face 23*a* is allowed to be reflected on the inner location 23*a* which extends along the circumferential edge 23 of the lens surface 18, so that the white area E having the relatively wide width which corresponds to the width W of the end face 32*a* can be secured in the inner location 23*a* of the circumferential edge 23.

Next, a comparison example will be described based upon FIGS. 5A and 5B.

Figure 5A:
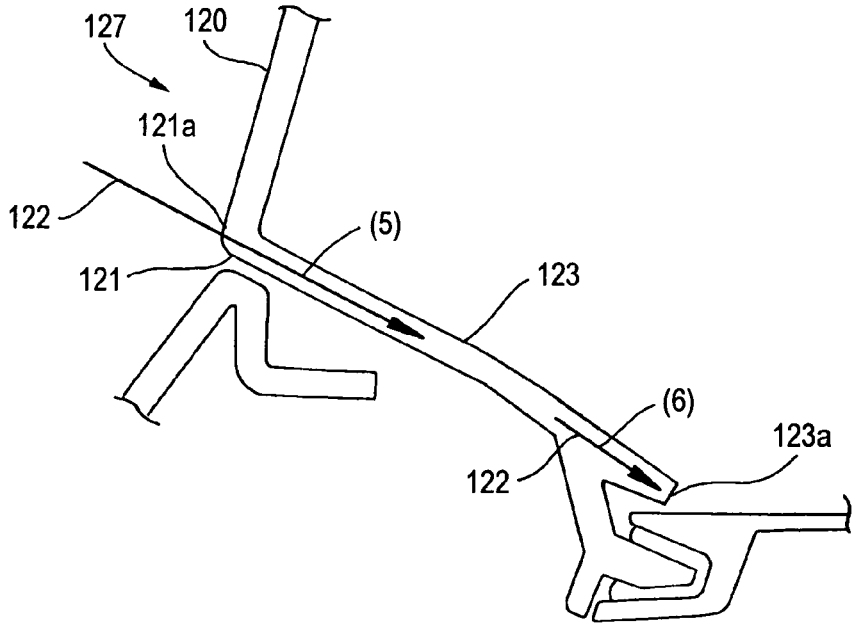
FIGS. 5A and 5B are explanatory views illustrating the function of a comparison example to the automotive headlamp of the invention.
Figure 5B:
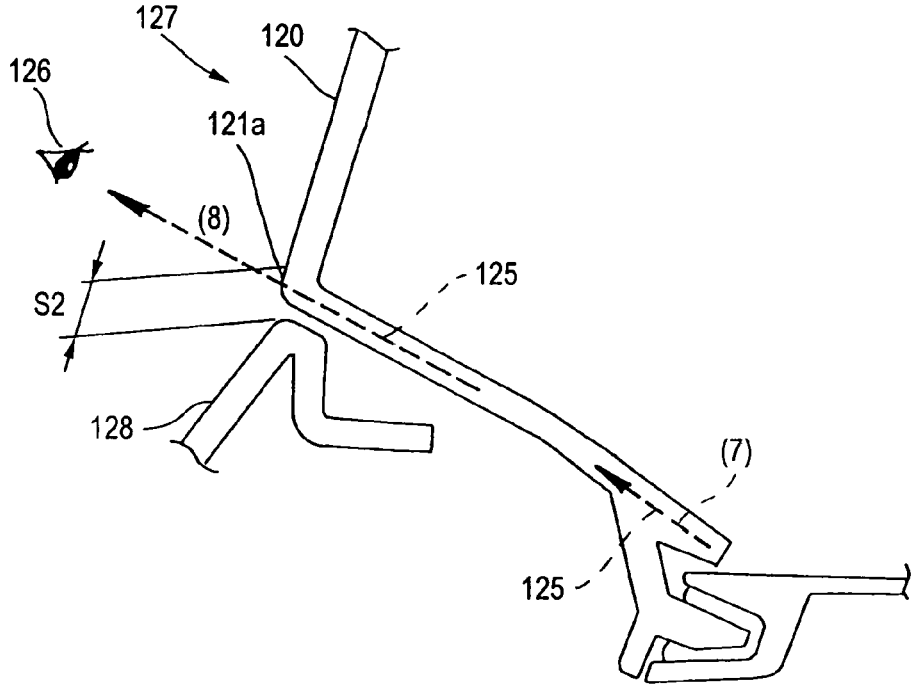
Figure 6:
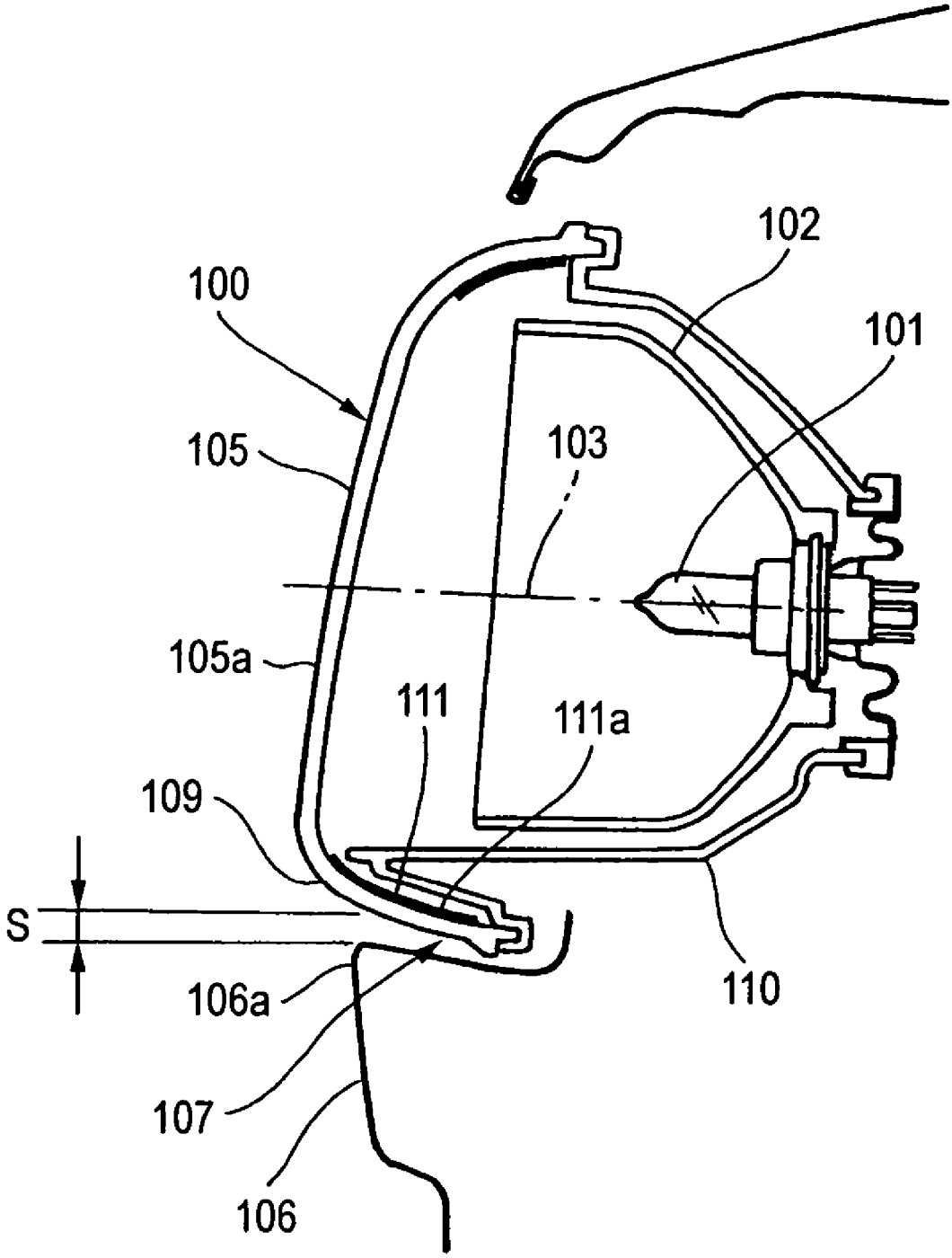
FIG. 6 is a cross-sectional view illustrating a condition in which a related automotive headlamp is mounted in a vehicle body.

FIGS. 5A and 5B are explanatory diagrams illustrating a comparison example to the automotive headlamp of the invention In FIG. 5A, external light 122 such as the sun's rays enters a lens flange portion 123 from an inner location 121*a* which extends along a circumferential edge 121 of a lens surface 120 as indicated by an arrow ⑤. The external light 122 that has so entered then enters an end face 123*a* of the lens flange portion 123 substantially at right angles as indicated by an arrow ⑥.

Since the end face 123*a* of the lens flange portion 123 constitutes a transparent and flat plane, almost all of the external light 122 that has so entered the lens flange portion 123 transmits through the end face 123*a*.

In FIG. 5B, a slight portion of the external light 122 (refer to FIG. 5A) which has not transmitted through the end face 123*a* is reflected at the end face 123*a* as indicated by an arrow ⑦. This reflected light 125 reaches the eye 126 of a person who stands in front of the vehicle as indicated by an arrow ⑧.

Since the reflected light 125 is so slight in amount, however, that the inner location 121*a* which extends along the circumferential edge 121 of the lens flange portion 123 looks transparent.

Thus, since the inner location 121*a* which extends along the circumferential edge 121 of the lens flange portion 123 looks transparent, a gap S2 between an automotive headlamp 127 and a vehicle body 128 looks so large that the gap S2 becomes visible.

Next, a second embodiment of the invention will be described.

An automotive headlamp according to the second embodiment is such that painting with for example, a white paint is applied to the surface 25 of the end portion instead of the surface-roughening process in which the embosses 25*a* . . . are formed the surface 25 of the end portion, the other constructions of the second embodiment remain the same as those described with respect to the first embodiment.

According to the second embodiment, external light that has entered the lens flange portion 24 can be reflected at the surface 25 of the end portion, whereby the inner location 23*a* which extends along the circumferential edge 23 of the lens surface 18 is allowed to look white.

Note that while, in the previous embodiment, the example is described in which the surface-roughening process is applied to the surface 25 of the end portion using the embossing and knurling processes, the surface 25 of the end portion can be roughened by using other surface-roughening processes.

In addition, while, in the previous embodiment, the example is described in which the inner and outer corners 33, 34 of the end 32 of the surface 25 of the end portion of the lens flange portion 24 are formed so that the corners become substantially square, the invention is not limited to this construction, and only one of the corners may be made square, or neither of the inner and outer corners 33, 34 may be made substantially square.

Furthermore, while, in the previous embodiment, the example is described in which the end face 32*a* of the lens flange portion 24 is formed such as to allow the external light 36 such as the sun's rays to enter at right angles, the external light 36 may not enter the end face 32*a* at right angles.

In addition, while, in the previous embodiment, the example is described in which the lens surface 18 is formed so as to follow the outline of the external surface 19 of the vehicle body when the automotive headlamp 10 is accommodated in the accommodation space 17 in the vehicle body 16, the invention is not limited to the lens surface 18 that is configured like that. For example, the invention can be applied to lens surfaces which protrude or are recessed.

Furthermore, while, in the previous embodiment, the example is described in which the surface-roughening process using the embosses 25*a* . . . or the painting using the white paint is applied to the surface 25 of the end portion, the same surface-roughening process or the same painting may be applied to the inside of the lens flange portion 24 and the inner circumferential surface of the lens surface 18, in addition to the surface 25 of the end portion.

Being constructed as is described heretofore, the invention exhibits the following advantages.

According to the first aspect of the invention, the lens flange portion is caused to extend from the circumferential edge of the lens surface toward the lamp housing, and the surface-roughening process or painting is applied to the surface of the end portion of the lens flange portion, whereby when the external light enters from the circumferential edge of the lens surface, the external light is reflected and diffused at the surface of the end portion or is reflected at the painted location.

From this construction, the lens flange portion is allowed to look white, so that the circumferential edge of the lens surface is then allowed to look larger. Thus, by allowing the circumferential edge of the lens surface to look larger, the gap between the automotive headlamp and the vehicle body looks as if the gap is totally eliminated or reduced, thereby making it possible to make the gap invisible.

Furthermore, the leg portion is caused to extend from the location which deviates from the surface of the end portion to which the surface-roughening process or painting is applied in such a manner as to bypass the surface of the end portion, so that the leg portion fits in the lamp housing.

From this construction, the fitting portion where the leg portion fits in the lamp housing is spaced away from the surface of the end portion to which the surface-roughening process or painting is applied so as to form the space between the fitting portion and the surface of the end portion.

From this construction, it becomes possible to avoid the reflection of the shadow of the fitting portion on the surface of the end portion, so that the reflection of the shadow of the fitting portion in the circumferential edge of the lens surface can in turn be prevented. Consequently, it is possible to make the circumferential edge of the lens surface look sharply, whereby the gap between the automotive headlamp and the vehicle body can be made invisible further.

What is claimed is:

1. An automotive headlamp comprising:

a lamp housing provided on a vehicle, a lens provided on the lamp housing, a lens flange portion formed on the lens, and a leg portion formed on the lens flange portion, wherein a surface of the lens is positioned in an opening in an accommodation space when the headlamp is accommodated in the accommodation space, the lens flange portion extends from a circumferential edge of the lens surface toward the lamp housing, surface-roughening or painting is applied to a surface of a terminal end portion of the lens flange portion, wherein the surface of the terminal end portion includes a terminal end face of the lens flange portion, and the leg portion extends from a location which deviates from the surface of the terminal end portion so as to bypass the surface of the end portion, and the leg portion fits in the lamp housing.

2. The automotive headlamp as in the claim 1, wherein the terminal end portion has an end that includes the end face, and the end includes an inner corner that is substantially square.

3. The automotive headlamp as in claim 1, wherein the terminal end portion has an end that includes the end face, and the end includes an outer corner that is substantially square.

4. The automotive headlamp as in claim 1, further comprising a reflector disposed within the lamp housing, the reflector being mounted so as to be movable toward and away from the lamp housing, the terminal end portion of the lens flange portion extends to a position generally between the reflector and the lamp housing, and a range of the surface-roughening or painting applied to the surface of the terminal end portion is positioned outside of the reflector.

5. The automotive headlamp as in claim 1, wherein the leg portion and the lamp housing are positioned within the accommodation space of the vehicle near the surface-roughening or painting applied to the surface of the terminal end portion of the lens flange portion.

* * * * *